US005291255A

United States Patent [19]

Britto et al.

[11] Patent Number: 5,291,255

[45] Date of Patent: Mar. 1, 1994

[54] IMAGING APPARATUS WITH STRAIGHT PATH FIXING

[75] Inventors: Ignatius L. Britto; Alexander D. Meade; Ashok Murthy; Iraj D. Shakib; William F. Voit, Jr., all of Lexington, Ky.

[73] Assignee: Lexmark International, Inc., Greenwich, Conn.

[21] Appl. No.: 945,195

[22] Filed: Sep. 15, 1992

[51] Int. Cl.[5] ..... G03G 15/20

[52] U.S. Cl. ..... 355/285; 219/216; 355/290

[58] Field of Search ..... 355/282, 285, 289, 290, 355/293; 219/216; 346/153.1

[56] References Cited

U.S. PATENT DOCUMENTS

| | | | |
|---|---|---|---|
| 3,851,964 | 12/1974 | Smith et al. | 355/280 |
| 4,455,079 | 6/1984 | Miwa et al. | 355/279 |
| 4,518,976 | 5/1985 | Tarumi et al. | 346/153.1 |
| 4,755,849 | 7/1988 | Tarumi et al. | 219/216 |
| 4,859,831 | 8/1989 | Webb | 219/216 |
| 4,912,514 | 3/1990 | Mizutani | 355/272 |
| 5,023,038 | 6/1991 | Aslam et al. | 355/290 X |
| 5,041,718 | 8/1991 | d'Hondt et al. | 355/282 X |
| 5,057,875 | 10/1991 | Itoh | 355/290 X |
| 5,083,165 | 1/1992 | Landa | 355/256 |

*Primary Examiner*—Leo P. Picard
*Assistant Examiner*—Christopher Horgan
*Attorney, Agent, or Firm*—John A. Brady

[57] ABSTRACT

An electrophotographic printer with fixing of the final image on paper (27) by first preheating the image side of the paper on a plate (25) which is in a straight path with the nip of a heated transfer roller (17) and a heated backing roller (21). This permits high temperatures need for fixing liquid toners and avoids paper curling.

4 Claims, 2 Drawing Sheets

IMAGING APPARATUS WITH STRAIGHT PATH FIXING

TECHNICAL FIELD

This invention relates to electrophotographic printing, and copying and, more specifically, to fixing final toner images with heat. Fixing by heat results in image formed of toner particles being melted on paper or other substrate, and then solidified at room temperature into a permanent image.

BACKGROUND OF THE INVENTION

Fixing the final toner image with heat is widely standard in electrophotographic apparatus. In this invention, heating is at two stages, one immediately prior to final fixing and one being final fixing in which the paper is pressed between an intermediate member carrying the image as toner particles and a heated roller. In this invention the surface of the paper which will receive the toner is directly heated in the first stage.

U.S. Pat. No. 3,851,964 to Smith et al employs hot air manifolds to heat the final paper prior to transfer of the image directly from the photoconductor surface. At the location of image transfer the paper passes around a roller termed a printing roller and is directed under another heating manifold. Preheating particularly improves results for liquid toner systems. The toner in this patent is liquid, as is the preferred toner in this application.

U.S. Pat. No. 4,755,849 to Tarumi at al discloses embodiments of an electrophotographic imaging system having an intermediate image transfer member, transfer and fixing with heat and by contact between the transfer member and an opposing roller, and preheating of the final paper directly with a heated plate contacting the side receiving the image. Except for the FIG. 5 embodiment, the heated plate is part of a guide path in which the paper is bent. In the FIG. 5 embodiment the intermediate transfer member is not employed, but the plate contacts the paper on the side opposite the image.

U.S. Pat. No. 4,455,079 to Miwa et al discloses a preheating member on the print-receiving side of the paper curved around a pressure roller. Similarly, U.S. Pat. No. 4,518,976 to Tarumi et al discloses a preheating member on the print-receiving side of the paper curved around the pressure roller as well at least one other embodiment (FIG. 10) in which the heating is to the opposite side.

DISCLOSURE OF THE INVENTION

In an electrophotographic imaging apparatus fixing of the final image on paper or other substrate is preceded by preheating the surface to receive toner on a flat fixing iron in a straight path with a nip area between an intermediate transfer member carrying the image and a fixing iron. The straight path permits a high level of heating without curling the paper, and the high temperatures are particularly important for fixing liquid toners.

This invention provides a degree of heat for fixing greater than available from radiant heating or heating only the roller away from the toned surface and does not require silicone oil or the like, as is commonly used, as a release agent to prevent toner from staying on the fixing iron surface.

BRIEF DESCRIPTION OF THE DRAWINGS

The details of this invention will be described in connection with the accompanying drawing, in which.

BEST MODE FOR CARRYING OUT THE INVENTION

Figure 1:
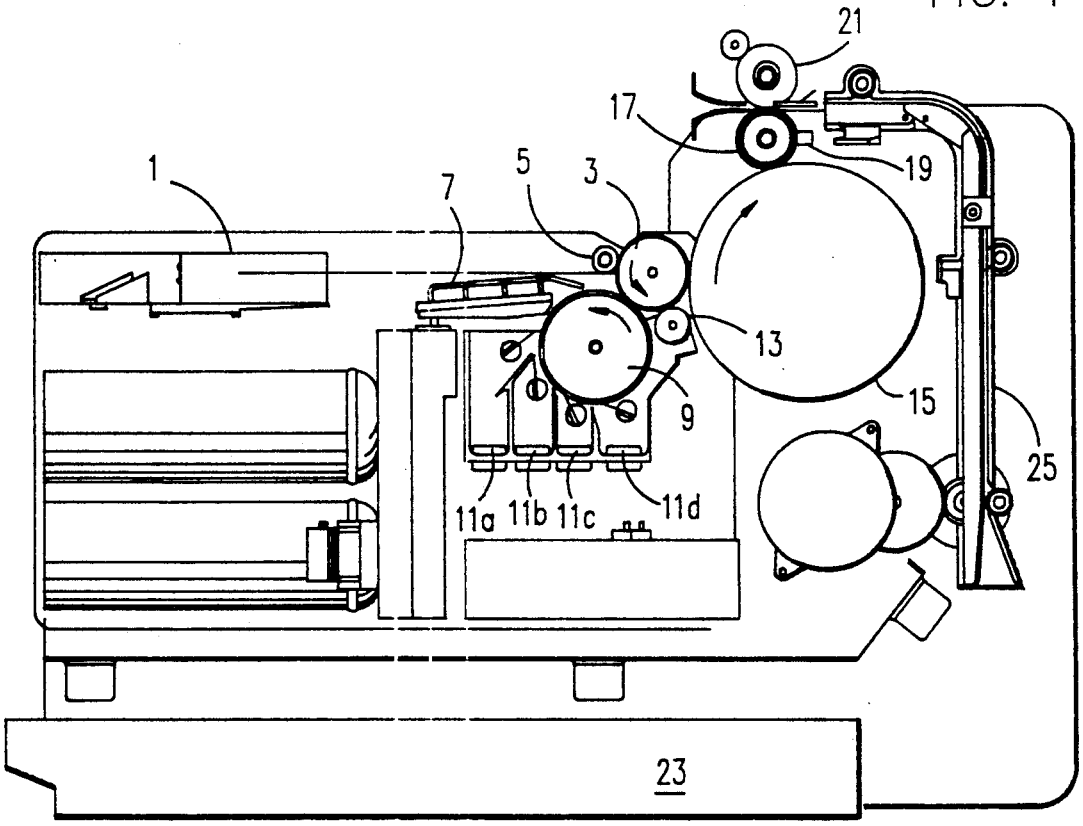
FIG. 1 illustrates a printer employing this invention.

As shown in FIG. 1, a laser printhead 1 operates on a photoconductive drum 3 which is electrically charged by a charge roller 5. Liquid toner is applied by nozzles between drum 3 and a countermoving roller 9. Toner is applied sequentially in three colors and in black to form a full-spectrum, colored image. That toner which is not captured by the drum 3 is moved by roller 9 and directed to a tank 11*a*, 11*6*, 11*c*, & 11*d* corresponding to the color of the toner. Squeegee roller 13 removes excess liquid from drum 3.

Each toned image is transferred by contact with accumulator drum 15. For a colored image, drum 3 separately receives the image from laser 1 of each of the three colors and black, and each image is separately developed and transferred to accumulator drum 15 in registration with the other images. Until the four images are on drum 15, transfer roller 17 is spaced away from drum 15. To apply the images to final paper, transfer roller 17 is moved laterally by solenoid 19 into contact with drum 15.

Fixing roller 21 opposes roller 17 to form a pressure nip for the final transfer and fixing on paper.

The foregoing need not be novel to implement this invention and therefore is described only generally and illustratively. The printer would have a number of elements not specifically mentioned such a cleaning mechanism for drum 3 and toner resupply mechanism.

Figure 2:
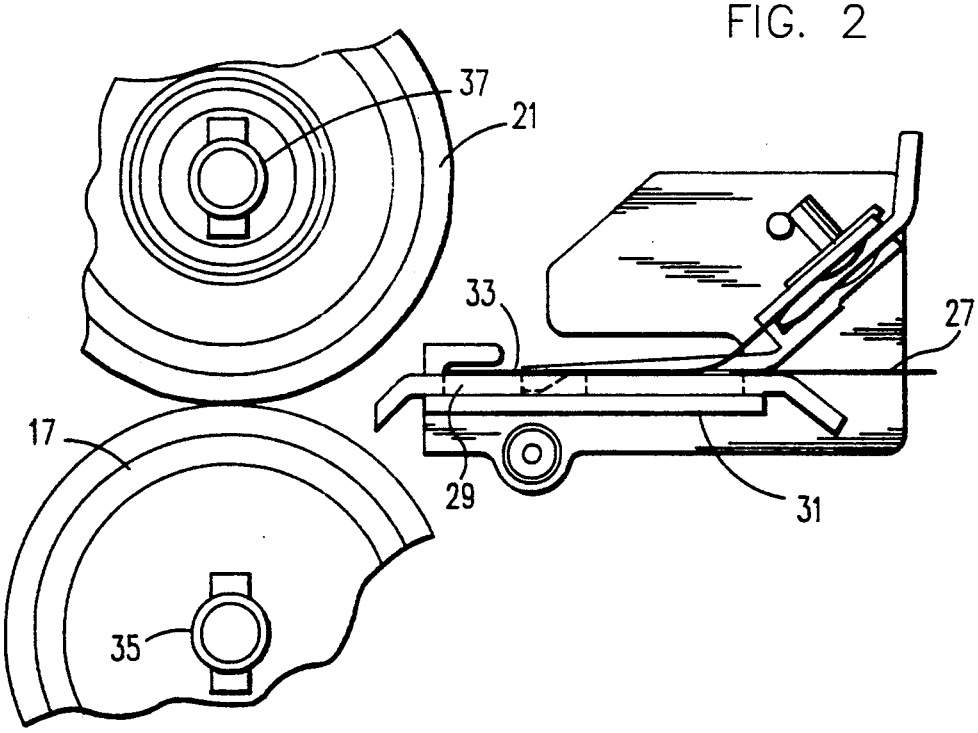
FIG. 2 is a side view of the fixing members.

Paper for the final image is stored in a lower tray 23 and moves through a guide track 25, which may be conventional, prior to preheating for fixing. FIG. 2 illustrates paper 27 where it contacts a flat surface of preheating plate 29 which faces roller 21 is heated by an electrical heating element 31. This occurs as the paper is moved steadily toward the nip of rollers 17 and 21. Direct contact of paper 27 with plate 29 is assured by flat spring 33 bent against plate 29. Both rollers 17 and 21 have conventional, internal heating lamps 35 and 37 respectively. The plane of plate 29 contains the extended tangent line of the nip of rollers 17 and 21. Accordingly, the fixing path of paper 27 is straight and no curling of paper 27 is experienced even though the fixing temperatures are high enough to fix a mineral oil vehicle liquid toner before the oil separates from the solids.

Figure 3:
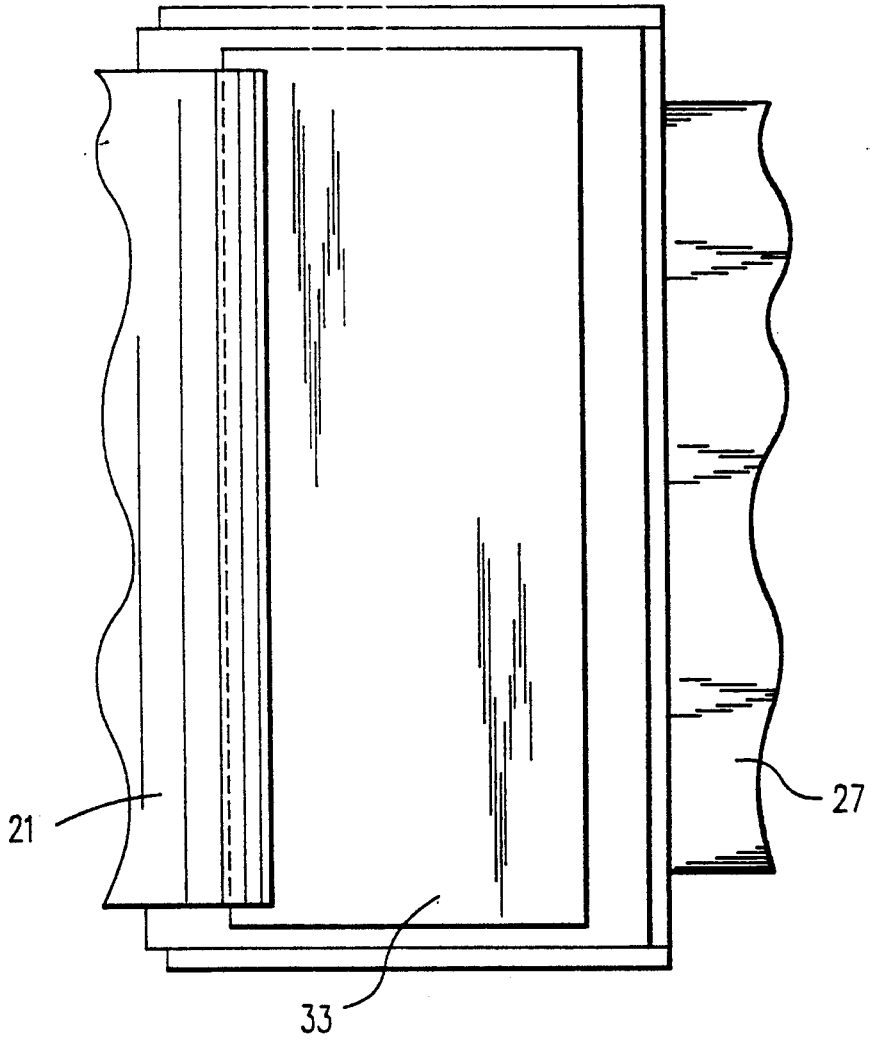
FIG. 3 is a top view of the fixing members.

As shown in FIG. 3 spring 33 is wider than paper 27, which is of standard 8½inch width. Rollers 21 and 17 (roller 17 not shown in FIG. 3) are both wider than paper 27 to assume firm contact with paper 27.

Liquid toner has a low surface energy and low cohesive strength which causes the toner, when molten, to tend to adhere to fusing surfaces. The result is degraded image and fuser roll contamination. Fusing before the vehicle separates into the paper reverses this tendency. No silicone oil or other outside release agent need be employed in the embodiment shown.

It will be recognized that implementations can take various forms, all within the spirit and scope of this invention.

What is claimed is:

1. An electrophotographic imaging apparatus comprising a photoconductive surface, means for charging said photoconductive surface, means for exposing said charged surface to an optical image to at least partially discharge said charged surface in the pattern of said image, means to develop said image on said surface by applying toner to said image, an endless transfer member positioned to receive said toned image after said toned image is transferred from said toned photoconductive surface, an endless fixing member positioned to press paper or other image receiving substrate between said transfer member and said fixing member, means internal to said transfer member to heat said transfer member where said transfer member and said fixing member form said press location, means internal to said fixing member to heat said fixing member where said transfer member and said fixing member form said press location, a plate, means to heat said plate, said plate having a flat surface located so that the plane constituting an extension of said flat surface facing said fixing member substantially contains the tangent of said press location of said fixing member and said transfer member, a flat spring having surface coextensive with said flat surface positioned to urge by the resilience of said spring said paper against said flat surface, and substrate feeding means to move said paper or other substrate in a straight path across said flat surface of said plate to preheat for fixing the image-receiving side of said paper or other substrate and then between said fixing member and said transfer member while said image is transferred to said paper or other substrate and fixed by heat.

2. The imaging apparatus as in claim 1 in which said means to develop comprises a liquid toner from which said particulate toner is applied.

3. An electrophotographic imaging apparatus comprising a photoconductive surface, means for charging said photoconductive surface, means for exposing said charged surface to an optical image to at least partially discharge said charged surface in the pattern of said image, means to develop said image on said surface by applying toner to said image, an endless transfer member positioned to receive said toned image after said toned image is transferred from said toned photoconductive surface, an endless fixing member positioned to press paper or other image receiving substrate between said transfer member and said fixing member, means to heat said transfer member and said fixing member where said transfer member and said fixing member form said press location, a plate, means to heat said plate, said plate having a flat surface located so that the plane constituting an extension of said flat surface facing said fixing member substantially contains the tangent of said press location of said fixing member and said transfer member, a flat spring having surface coextensive with said flat surface positioned to urge by the resilience of said spring said paper against said flat surface, and substrate feeding means to move said paper or other substrate in a straight path across said flat surface of said plate to preheat for fixing the image-receiving side of said paper or other substrate and then between said fixing member and said transfer member while said image is transferred to said paper or other substrate and fixed by heat.

4. The imaging apparatus as in claim 3 in which said means to develop comprises a liquid toner from which said particulate toner is applied.

* * * * *